US010262610B2

(12) United States Patent
Lee et al.

(10) Patent No.: US 10,262,610 B2
(45) Date of Patent: Apr. 16, 2019

(54) BACKLIGHT UNIT, METHOD OF DRIVING THE SAME, AND DISPLAY DEVICE HAVING THE SAME

(71) Applicant: SAMSUNG DISPLAY CO., LTD., Yongin-si, Gyeonggi-do (KR)

(72) Inventors: Jeongbong Lee, Hwaseong-si (KR); Yujin Kim, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 114 days.

(21) Appl. No.: 15/209,655

(22) Filed: Jul. 13, 2016

(65) Prior Publication Data

US 2017/0110068 A1 Apr. 20, 2017

(30) Foreign Application Priority Data

Oct. 16, 2015 (KR) ..... 10-2015-0144898

(51) Int. Cl.
*G09G 3/34* (2006.01)
*G09G 3/36* (2006.01)

(52) U.S. Cl.
CPC ..... *G09G 3/3648* (2013.01); *G09G 3/342* (2013.01); *G09G 2300/0426* (2013.01); *G09G 2320/0233* (2013.01); *G09G 2320/064* (2013.01); *G09G 2320/0646* (2013.01); *G09G 2320/0653* (2013.01)

(58) Field of Classification Search
CPC ..... G09G 3/3406
See application file for complete search history.

(56) References Cited

U.S. PATENT DOCUMENTS

2008/0055230 A1* 3/2008 Jang ..... G09G 3/3406 345/102
2009/0015179 A1 1/2009 Hatano et al.
2009/0289569 A1* 11/2009 Yoshida ..... H05B 41/2821 315/246
2012/0019160 A1* 1/2012 Lee ..... H05B 33/0851 315/291
2015/0009239 A1 1/2015 Hsu et al.
2015/0084546 A1 3/2015 Kubo
(Continued)

FOREIGN PATENT DOCUMENTS

JP 2010-122648 A 6/2010
KR 10-2014-0025862 A 3/2014
KR 10-2014-0086682 A 7/2014

*Primary Examiner* — Amr A Awad
*Assistant Examiner* — Stephen A Bray
(74) *Attorney, Agent, or Firm* — Lewis Roca Rothgerber Christie LLP

(57) ABSTRACT

There is provided a backlight unit including a backlight configured to generate light, and a backlight driving circuit configured to drive the backlight in a dimming mode on a basis of a dimming signal, the backlight driving circuit including a first comparator configured to detect a frequency of the dimming signal and to compare the frequency of the dimming signal with a reference frequency to determine a compared result, and a driver configured to selectively drive the backlight, based on the compared result, in an analog dimming mode in which a driving current of the backlight is controlled, or a mixed dimming mode by mixing the analog dimming mode and a digital dimming mode in which an on state and an off state of the backlight is controlled.

15 Claims, 8 Drawing Sheets

(56) References Cited

U.S. PATENT DOCUMENTS

2015/0223299 A1* 8/2015 Stockstad ..... H05B 33/0815
315/294
2015/0359057 A1* 12/2015 Lee ..... G09G 3/3406
345/691

* cited by examiner

BACKLIGHT UNIT, METHOD OF DRIVING THE SAME, AND DISPLAY DEVICE HAVING THE SAME

CROSS-REFERENCE TO RELATED APPLICATION

This U.S. non-provisional patent application claims priority to and the benefit of Korean Patent Application No. 10-2015-0144898, filed on Oct. 16, 2015, the content of which is hereby incorporated by reference in its entirety.

BACKGROUND

1. Field

Aspects of the present disclosure relate to a backlight unit, a method of driving the backlight unit, and a display device including the backlight unit.

2. Description of the Related Art

In general, a liquid crystal display device includes a display panel on which pixels are arranged, a gate driver applying gate signals to the pixels, a data driver applying data voltages to the pixels, and a backlight unit applying a light to the display panel.

The pixels receive the data voltages in response to the gate signals and are operated in response to the data voltages. The pixels operated by the data voltages control a transmittance of the light provided from the backlight unit to display an image.

The backlight unit is operated in a dimming mode. The dimming mode is used to control an amount of the light from the backlight unit in consideration of brightness of the image, and thus power consumption in the backlight unit is reduced.

The dimming mode is classified into an analog dimming mode and a digital dimming mode. The digital dimming mode is performed by a pulse width modulation (PWM) method. The analog dimming mode controls an amount of electrical current applied to a light source while the light source of the backlight unit is in a full-on state, and thus brightness of the backlight unit is controlled. The digital dimming mode controls an ON/OFF of the light source to control the brightness of the backlight unit.

SUMMARY

Aspects of embodiments of the present disclosure are directed toward a backlight unit capable of improving display quality.

Aspects of embodiments of the present disclosure are directed toward a method of driving the backlight unit.

Aspects of embodiments of the present disclosure are directed toward a display device having the backlight unit.

According to some embodiments of the inventive concept, there is provided a backlight unit including: a backlight configured to generate light; and a backlight driving circuit configured to drive the backlight in a dimming mode on a basis of a dimming signal, the backlight driving circuit including: a first comparator configured to detect a frequency of the dimming signal and to compare the frequency of the dimming signal with a reference frequency to determine a compared result; and a driver configured to selectively drive the backlight, based on the compared result, in an analog dimming mode in which a driving current of the backlight is controlled, or a mixed dimming mode by mixing the analog dimming mode and a digital dimming mode in which an on state and an off state of the backlight is controlled.

In an embodiment, the dimming signal is a pulse width modulation signal.

In an embodiment, the reference frequency is about 1 KHz.

In an embodiment, the driver is configured to drive the backlight in the analog dimming mode when the frequency of the dimming signal is less than the reference frequency, and to drive the backlight in the mixed dimming mode when the frequency of the dimming signal is equal to or greater than the reference frequency.

In an embodiment, the driver is configured to selectively drive the backlight in the analog dimming mode or the digital dimming mode in accordance with a duty cycle of the dimming signal when the frequency of the dimming signal is equal to or greater than the reference frequency.

In an embodiment, the driver is configured to drive the backlight in the analog dimming mode when the duty cycle of the dimming signal is equal to or greater than a reference duty cycle, and to drive the backlight in the digital dimming mode when the duty cycle of the dimming signal is less than the reference duty cycle.

In an embodiment, the reference duty cycle is about 25%.

In an embodiment, the first comparator includes: a frequency detector configured to detect the frequency of the dimming signal; and a frequency comparator configured to compare the frequency of the dimming signal with the reference frequency to output the compared result.

In an embodiment, the frequency comparator is configured to output a first control signal when the frequency of the dimming signal is less than the reference frequency, and to output a second control signal when the frequency of the dimming signal is equal to or greater than the reference frequency.

In an embodiment, the driver includes: a duty cycle detector configured to detect a duty cycle of the dimming signal in response to the second control signal; a duty cycle comparator configured to compare the duty cycle of the dimming signal with a reference duty cycle, to output a third control signal when the duty cycle of the dimming signal is equal to or greater than the reference duty cycle, and to output a fourth control signal when the duty cycle of the dimming signal is less than the reference duty cycle; a first driver configured to drive the backlight in the analog dimming mode on a basis of the dimming signal in response to the first and third control signals; and a second driver configured to drive the backlight in the digital dimming mode on the basis of the dimming signal in response to the fourth control signal.

In an embodiment, the frequency comparator includes a first memory configured to store a value of the reference frequency, and the duty cycle comparator includes a second memory configured to store a value of the reference duty cycle.

According to some embodiments of the inventive concept, there is provided a method of driving a backlight unit, the method including: detecting a frequency of a dimming signal; comparing the frequency of the dimming signal with a reference frequency to determine a compared result; and selectively driving a backlight, based on the compared result, in an analog dimming mode in which a driving current of the backlight is controlled, or a mixed dimming mode by mixing the analog dimming mode and a digital dimming mode in which an on state and an off state of the backlight are controlled.

In an embodiment, the reference frequency is about 1 KHz.

In an embodiment, the driving of the backlight includes: driving the backlight in the analog dimming mode on a basis of the dimming signal when the frequency of the dimming signal is less than the reference frequency; and driving the backlight in the mixed dimming mode on the basis of the dimming signal when the frequency of the dimming signal is equal to or greater than the reference frequency.

In an embodiment, the driving of the backlight in the mixed dimming mode includes: detecting a duty cycle of the dimming signal; comparing the duty cycle of the dimming signal with a reference duty cycle; and driving the backlight in the analog dimming mode or the digital dimming mode according to a result of the comparison of the duty cycle of the dimming signal and the reference duty cycle.

In an embodiment, the reference duty cycle is about 25%.

In an embodiment, the driving of the backlight in the analog dimming mode or the digital dimming mode includes: driving the backlight in the analog dimming mode on the basis of the dimming signal when the duty cycle of the dimming signal is equal to or greater than the reference duty cycle; and driving the backlight in the digital dimming mode on the basis of the dimming signal when the duty cycle is less than the reference duty cycle.

According to some embodiments of the inventive concept, there is provided a display device including: a display panel; a backlight configured to provide light to the display panel; a first comparator configured to detect a frequency of a dimming signal and to compare the frequency of the dimming signal with a reference frequency to determine a compared result; and a driver configured to selectively drive the backlight in a dimming mode on a basis of the dimming signal, wherein the driver is configured to drive the backlight, based on the compared result, in an analog dimming mode in which a driving current of the backlight is controlled or a mixed dimming mode by mixing the analog dimming mode and a digital dimming mode in which on and off of the backlight are controlled.

In an embodiment, the first comparator includes: a frequency detector configured to detect the frequency of the dimming signal; and a frequency comparator configured to compare the frequency of the dimming signal with the reference frequency, to output a first control signal when the frequency of the dimming signal is less than the reference frequency, and to output a second control signal when the frequency of the dimming signal is equal to or greater than the reference frequency.

In an embodiment, the driver includes: a duty cycle detector configured to detect a duty cycle of the dimming signal in response to the second control signal; a duty cycle comparator configured to compare the duty cycle of the dimming signal with a reference duty cycle, to output a third control signal when the duty cycle of the dimming signal is equal to or greater than the reference duty cycle, and to output a fourth control signal when the duty cycle of the dimming signal is less than the reference duty cycle; a first driver configured to drive the backlight in the analog dimming mode on the basis of the dimming signal in response to the first and third control signals; and a second driver configured to drive the backlight in the digital dimming mode on the basis of the dimming signal in response to the fourth control signal.

According to one or more embodiments, the display device drives the backlight in the analog dimming mode or the mixed dimming mode according to the frequency of the dimming signal, and thus the waterfall phenomenon is prevented from occurring or is reduced. Thus, the display quality of the display device is improved.

BRIEF DESCRIPTION OF THE DRAWINGS

The above and other aspects of the present disclosure will become readily apparent by reference to the following detailed description when considered in conjunction with the accompanying drawings, wherein.

DETAILED DESCRIPTION

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Hereinafter, the present invention will be described in more detail with reference to the accompanying drawings.

Figure 1:
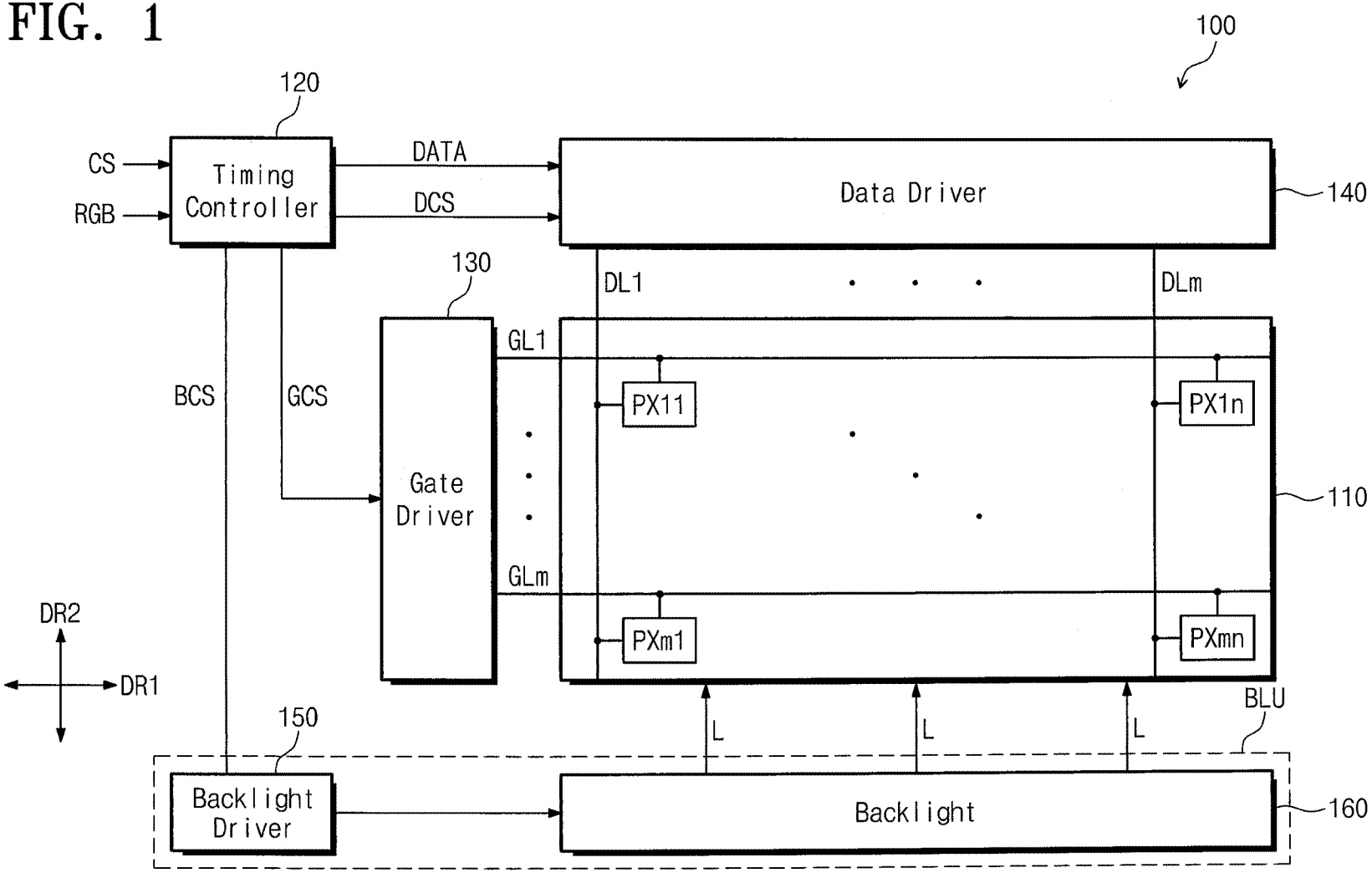
FIG. 1 is a block diagram showing a display device according to an exemplary embodiment of the present disclosure.

FIG. 1 is a block diagram showing a display device 100 according to an exemplary embodiment of the present disclosure.

Referring to FIG. 1, the display device 100 includes a display panel 110, a timing controller 120, a gate driver 130, a data driver 140, and a backlight unit BLU.

The display panel 110 may be, but is not limited to, a liquid crystal display panel including two substrates and a liquid crystal layer disposed between the two substrates. The display panel 110 includes a plurality of gate lines GL1 to GLm, a plurality of data lines DL1 to DLn, and a plurality of pixels PX11 to PXmn. Each of "m" and "n" is a natural number.

The gate lines GL1 to GLm extend in a first direction DR1 and are connected to the gate driver 130. The data lines DL1 to DLn extend in a second direction DR2 crossing (e.g., orthogonal to) the first direction DR1 and are connected to the data driver 140.

The pixels PX11 to PXmn are arranged in crossing areas defined by the crossing of the gate lines GL1 to GLm and the data lines DL1 to DLn. Accordingly, the pixels PX11 to PXmn are arranged in a matrix form. The pixels PX11 to PXmn are connected to the gate lines GL1 to GLm and the data lines DL1 to DLn.

The pixels PX11 to PXmn display a red, green, or blue color, but they should not be limited thereto or thereby. That is, the pixels PX11 to PXmn may further display various suitable colors, for example, a white color, a yellow color, a cyan color, a magenta color, and/or the like.

The timing controller 120 is mounted on a printed circuit board in an integrated circuit chip form and connected to the gate driver 130 and the data driver 140. The timing controller 120 receives image signals RGB and control signals CS from an external source, for example, a system board.

The timing controller 120 converts a data format of the image signals RGB to a data format appropriate to an interface between the data driver 140 and the timing controller 120. The timing controller 120 applies image data DATA having the converted data format to the data driver 140.

The image signals RGB include red image signals, green image signals, and blue image signals. In the case where the pixels PX11 to PXmn include red pixels displaying the red color, green pixels displaying the green color, and blue pixels displaying the blue color, the timing controller 120 converts the data format of the red, green, and blue image signals and applies the red, green, and blue image signals to the data driver 140.

In the case where the pixels PX11 to PXmn further include white pixels displaying the white color, the timing controller 120 generates the red, green, blue, and white image signals using the red, green, and blue image signals. The timing controller 120 converts the data format of the red, green, blue, and white image signals and applies the red, green, blue, and white image signals to the data driver 140.

The control signals CS include a vertical synchronization signal as a frame distinction signal, a horizontal synchronization signal as a row distinction signal, and a data enable signal maintained at a high level during a period, in which data are output, to indicate a data input period.

The timing controller 120 generates a gate control signal GCS and a data control signal DCS in response to the control signals CS. The gate control signal GCS is used to control an operation timing of the gate driver 130. The data control signal DCS is used to control an operation timing of the data driver 140.

The gate control signal GCS includes a scan start signal indicating the start of scanning, at least one clock signal controlling an output period of a gate-on voltage, and an output enable signal defining a duration of the gate-on voltage.

The data control signal DCS includes a horizontal start signal informing the start of data transmission of the image data DATA to the data driver 140, a load signal instructing to apply data voltages to the data lines DLI to DLn, and a polarity control signal determining a polarity of the data voltages with respect to a common voltage.

The timing controller 120 analyzes the image signals RGB and generates a backlight control signal BCS to control a brightness of the backlight unit BLU. The backlight control signal BCS is a control signal to drive the backlight unit BU in a dimming mode.

For instance, in the case where the image signals RGB are provided to display a dark image, the timing controller 120 generates the backlight control signal BCS to decrease a brightness of a light L generated by the backlight unit BLU. In the case where the image signals RGB are provided to display a bright image, the timing controller 120 generates the backlight control signal BCS to increase the brightness of the light L generated by the backlight unit BLU.

The timing controller 120 applies the gate control signal GCS to the gate driver 130 and applies the data control signal DCS to the data driver 140. The timing controller 120 applies the backlight control signal BCS to the backlight unit BLU.

The gate driver 130 generates the gate signals in response to the gate control signal GCS and sequentially outputs the gate signals. The gate signals are applied to the pixels PX11 to PXmn through the gate lines.

The data driver 140 generates the data voltages in analog form (to correspond to the image data DATA) in response to the data control signal DCS and outputs the data voltages. The data voltages are applied to the pixels PX11 to PXmn through the data lines DL1 to DLn.

The gate driver 130 and the data driver 140 are provided as driving chips, mounted on a flexible printed circuit board, and connected to the display panel 110 in a tape carrier package (TCP).

However, the gate driver 130 and the data driver 140 should not be limited to the above-mentioned structure. That is, the gate driver 130 and the data driver 140 may be provided as driving chips and mounted on the display panel 110 in a chip-on-glass (COG) manner. In addition, the gate driver 130 may be substantially concurrently (e.g., simultaneously) formed with transistors of the pixels PX11 to PXmn and mounted on the display panel 110 in an ASG (amorphous silicon TFT gate driver circuit) form or an OSG (oxide silicon TFT gate driver circuit) form.

The backlight unit BLU includes a backlight driver (e.g., a backlight driving circuit) 150 receiving the backlight control signal BCS and a backlight 160 driven by the control of the backlight driver 150. The backlight driver 150 drives the backlight 160 in the dimming mode in response to the backlight control signal BCS, such that the backlight 160 generates the light L having a set or predetermined brightness. The backlight control signal BCS includes a dimming signal as a pulse width modulation signal.

The backlight driver 150 drives the backlight 160 in the analog dimming mode or a mixed dimming mode obtained by mixing the analog dimming mode and the digital dimming (or PWM dimming) mode according to a frequency of the dimming signal. In the case where the backlight 160 is driven in the mixed dimming mode, the backlight driver 150 drives the backlight 160 in the analog dimming mode or the digital dimming mode.

The backlight 160 includes light emitting diodes or a cold cathode fluorescent lamp as its light source emitting the light L. The backlight 160 is disposed at a rear side of the display panel 110, and the light L generated by the backlight 160 is provided to the display panel 110.

The display panel 110 displays the image using the light L provided from the backlight 160. The pixels PX11 to PXmn receive the data voltages through the data lines DL1 to DLn in response to the gate signals provided through the gate lines GL1 to GLm.

The pixels PX11 to PXmn display grayscale levels corresponding to the data voltages, and thus the image is displayed. The pixels PX11 to PXmn operated by the data voltages control a transmittance of the light provided from the backlight 160 to display the image.

Figure 2:
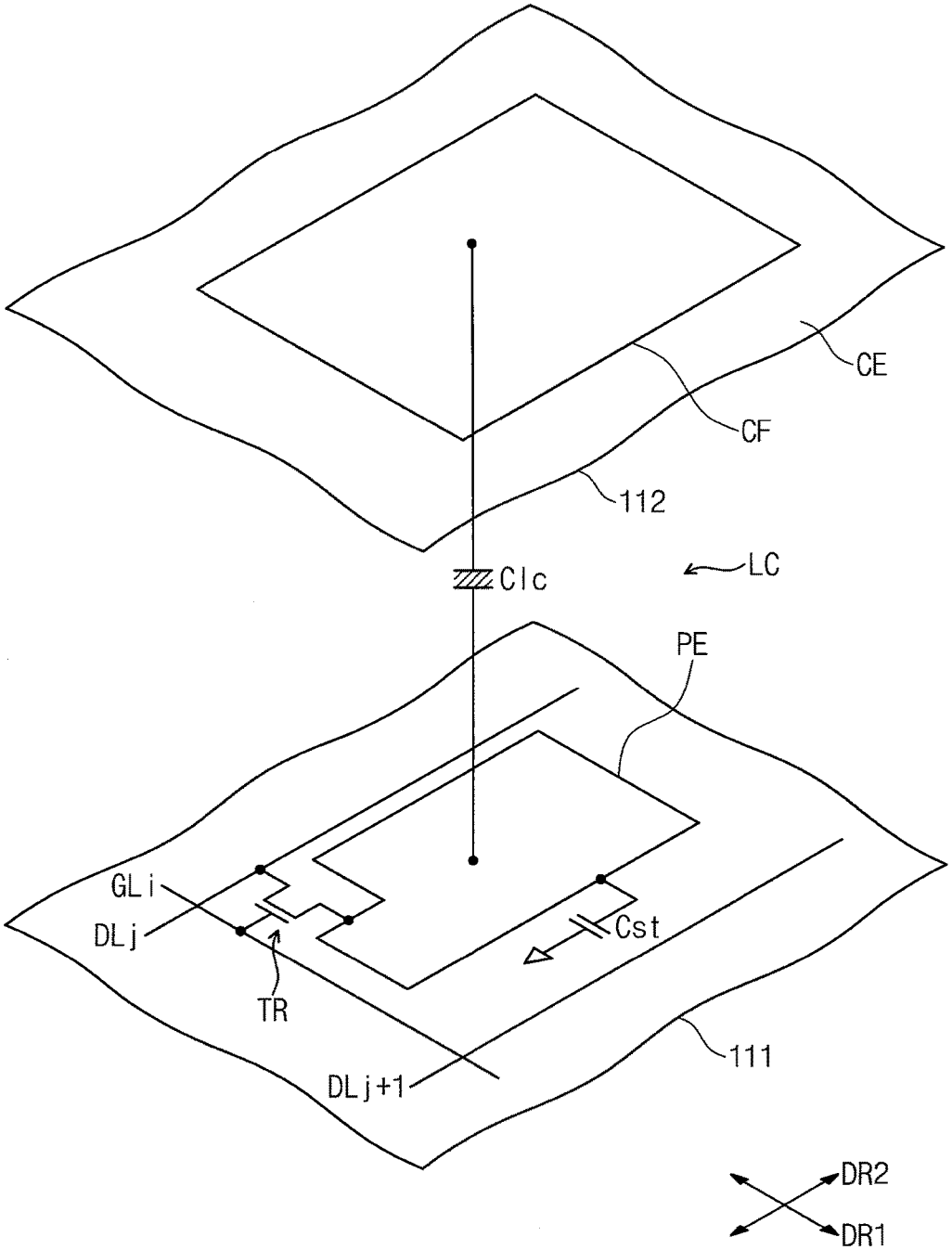
FIG. 2 is an equivalent circuit diagram showing a pixel shown in FIG. 1.

FIG. 2 is an equivalent circuit diagram showing one pixel shown in FIG. 1.

For the convenience of illustration, FIG. 2 shows a pixel PX connected to a gate line GLi and a data line DLj. The other pixels of the display panel 110 have the same or substantially the same structure and function as those of the pixel PX shown in FIG. 2.

Referring to FIG. 2, the display panel 110 includes a first substrate 111, a second substrate 112 facing the first substrate 111, and a liquid crystal layer LC disposed between the first substrate 111 and the second substrate 112.

The pixel PX includes a transistor TR connected to the gate line GLi and the data line DLj, a liquid crystal capacitor Clc connected to the transistor TR, and a storage capacitor Cst connected to the liquid crystal capacitor Clc in parallel. The storage capacitor Cst may be omitted.

The transistor TR is disposed on the first substrate 111. The transistor TR includes a gate electrode connected to the gate line GLi, a source electrode connected to the data line DLj, and a drain electrode connected to the liquid crystal capacitor Clc and the storage capacitor Cst.

The liquid crystal capacitor Clc includes a pixel electrode PE disposed on the first substrate 111, a common electrode CE disposed on the second substrate 112, and the liquid crystal layer LC disposed between the pixel electrode PE and the common electrode CE. The liquid crystal layer LC serves as a dielectric layer (e.g., substance). The pixel electrode PE is connected to the transistor TR.

As shown in FIG. 2, the pixel electrode PE has a non-slit structure, but it should not be limited thereto or thereby. That is, the pixel electrode PE may have a slit structure including a trunk portion having a cross shape and a plurality of branch portions extending from the trunk portion in a radial form.

The common electrode CE is disposed on an entire surface of the second substrate 112, but it should be limited thereto or thereby. That is, the common electrode CE may be disposed on the first substrate 111. In this case, at least one of the pixel electrode PE and the common electrode CE may have at least one slit.

The storage capacitor Cst includes the pixel electrode PE, a storage electrode branched from the storage line, and an insulating layer disposed between the pixel electrode PE and the storage electrode. The storage line is disposed on the first substrate 111 and formed on the same layer as the gate lines GL1 to GLm. The storage electrode is partially overlapped with the pixel electrode PE.

The pixel PX includes a color filter CF displaying one of red, green, and blue colors. As an example, the color filter CF is disposed on the second substrate 112 as shown in FIG. 2; however, the color filter CF may be disposed on the first substrate 111 according to other embodiments.

The transistor TR is turned on in response to the gate signal applied thereto through the gate line GLi. The data voltage provided through the data line DLj is applied to the pixel electrode PE of the liquid crystal capacitor Clc through the turned-on transistor TR. The common electrode CE is supplied (e.g., is applied) with the common voltage.

Due to a difference in voltage level between the data voltage and the common voltage, an electric field is generated between the pixel electrode PE and the common electrode CE. Liquid crystal molecules of the liquid crystal layer LC are driven by the electric field generated between the pixel electrode PE and the common electrode CE. The transmittance of the light provided from the backlight 160 is controlled by the liquid crystal molecules driven by the electric field, and thus the image is displayed.

The storage line receives a storage voltage having a constant voltage level, but it should not be limited thereto or thereby. For example, the storage line may receive the common voltage. The storage capacitor Cst compensates for the voltage charged in the liquid crystal capacitor Clc.

Figure 3:
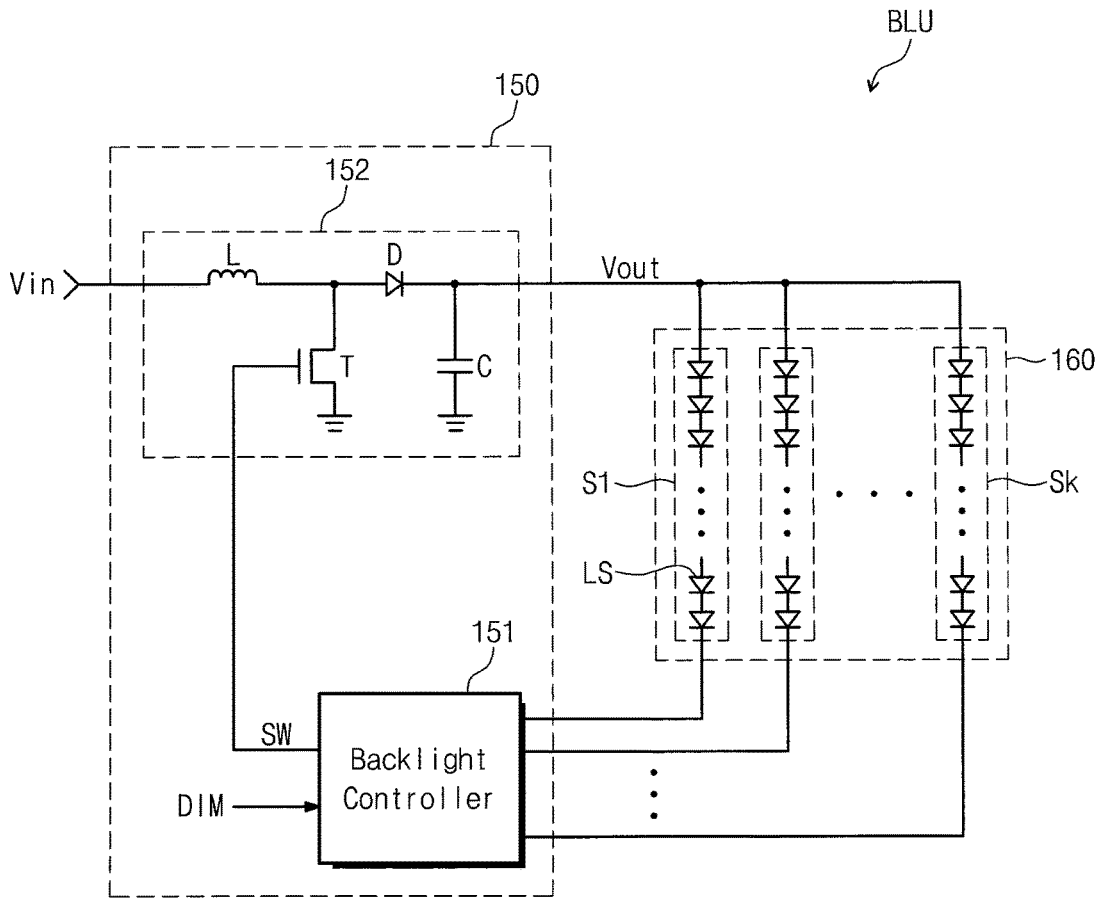
FIG. 3 is a block diagram showing a connection relation between a backlight driver and a backlight shown in FIG. 1.

FIG. 3 is a block diagram showing a connection relation between the backlight driver 150 and the backlight 160 shown in FIG. 1.

Referring to FIG. 3, the backlight driver 150 includes a backlight controller 151 and a boosting circuit 152. The backlight 160 includes a plurality of light source strings (e.g., a plurality of light source lines) S1 to Sk connected to each other in parallel. In the present exemplary embodiment, k is a natural number equal to or greater than 2. Each of the light source strings S1 to Sk includes a plurality of light sources LS connected to each other in series. Each light source LS may be, but is not limited to, a light emitting diode (LED).

An output terminal of the boosting circuit 152 is commonly connected to input terminals of the light source strings S1 to Sk. The boosting circuit 152 may include a DC/DC converter. The boosting circuit 152 receives an input voltage Vin and boosts the input voltage Vin to output a driving voltage Vout.

The driving voltage Vout output from the boosting circuit 152 is applied to the light source strings S1 to Sk to drive the light source strings S1 to Sk. In some examples, the driving voltage Vout has a voltage level from about 20 volts to about 35 volts.

The boosting circuit 152 includes a coil L, a diode D, a capacitor C, and a transistor T. The coil L includes a first terminal applied with the input voltage Vin and a second terminal connected to an anode terminal of the diode D.

A control terminal of the transistor T is connected to the backlight controller 151 to receive a switching signal SW. An input terminal of the transistor T is connected to the second terminal of the coil L and an output terminal of the transistor T is connected to a ground terminal. A cathode terminal of the diode D and a first terminal of the capacitor C are connected to an output terminal of the boosting circuit 152, from which the driving voltage Vout is output, and a second terminal of the capacitor C is connected to the ground terminal.

The transistor T is turned on or off in response to the switching signal SW and the coil L boosts the input voltage Vin in accordance with the on/off operation of the transistor T. The boosting circuit 152 controls a voltage level of the driving voltage Vout in response to the switching signal SW. For instance, the voltage level of the driving voltage Vout output from the boosting circuit 152 may be changed depending on a duty cycle of the switching signal SW.

When the duty cycle of the switching signal SW is decreased, the voltage level of the driving voltage Vout output from the boosting circuit 152 is decreased. When the duty cycle of the switching signal SW is increased, the voltage level of the driving voltage Vout output from the boosting circuit 152 is increased.

The backlight controller 151 is connected to the output terminal of the light source strings S1 to Sk to receive a current value from each of the light source strings S1 to Sk. The backlight controller 151 controls the duty cycle of the switching signal SW on the basis of the current value of each of the light source strings S1 to Sk, which is feedback thereto.

The backlight controller 151 compares the feedback current value (e.g., the sum total of the currents from the light source strings S1 to Sk fed back to the backlight controller 151) with a reference value. When the feedback current value is greater than the reference value, the backlight controller 151 decreases the duty cycle of the switching signal SW. When the feedback current value is less than the reference value, the backlight controller 151 increases the duty cycle of the switching signal SW.

As described above, because the duty cycle of the switching signal SW is controlled, the voltage level of the driving voltage Vout output from the boosting circuit 152 is controlled according to the level of the feedback voltage. As a result, the backlight 160 outputs the light at a constant brightness.

The backlight controller 151 receives a dimming signal DIM of the backlight control signal BCS. The dimming signal DIM may be, but is not limited to, the pulse width modulation (PWM) signal to control the brightness of each of the light source strings S1 to Sk. The backlight controller 151 controls the brightness of the light source strings S1 to Sk of the backlight 160 in response to the dimming signal DIM.

The backlight controller 151 detects a frequency of the dimming signal DIM and compares the detected frequency of the dimming signal DIM with a reference frequency. According to the compared result, the backlight controller 151 drives the backlight 160 in the analog dimming mode or the mixed dimming mode.

For instance, in the case where the frequency of the dimming signal DIM is less than the reference frequency, the backlight controller 151 drives the backlight 160 in the analog dimming mode. In the case where the frequency of the dimming signal DIM is equal to or greater than the reference frequency, the backlight controller 151 drives the backlight 160 in the mixed dimming mode.

In the case where the backlight controller 151 drives the backlight 160 in the mixed dimming mode, the backlight controller 151 detects the duty cycle of the dimming signal DIM and compares the detected duty cycle of the dimming signal DIM with a reference duty cycle. According to the comparison result, the backlight controller 151 drives the backlight 160 in the analog dimming mode or the digital dimming mode.

For instance, in the case where the duty cycle of the dimming signal DIM is equal to or greater than a reference duty cycle, the backlight controller 151 drives the backlight 160 in the analog dimming mode. In the case where the duty cycle of the dimming signal DIM is less than the reference duty cycle, the backlight controller 151 drives the backlight 160 in the digital dimming mode.

Figure 4:
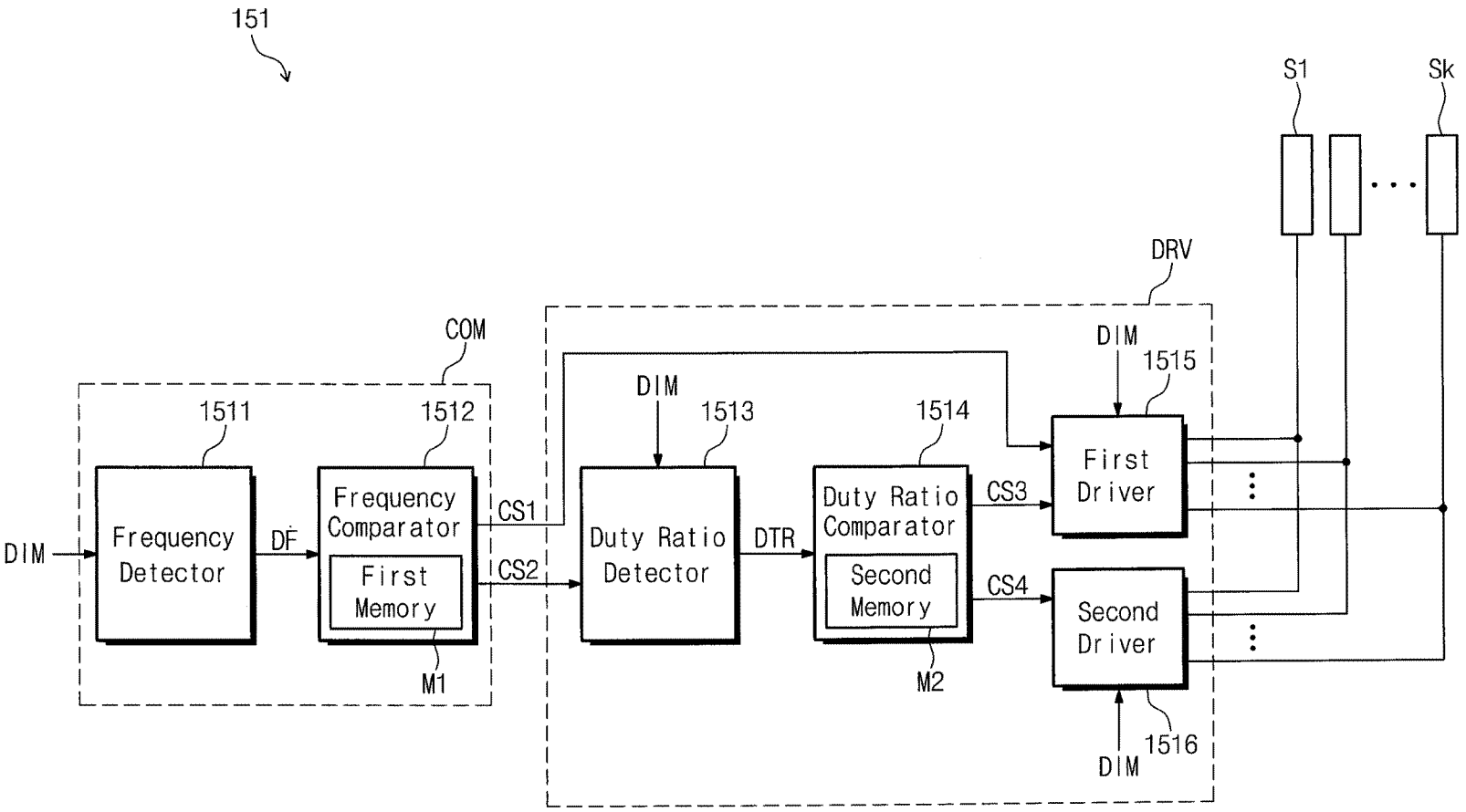
FIG. 4 is a block diagram showing a backlight controller shown in FIG. 3.
Figure 5:
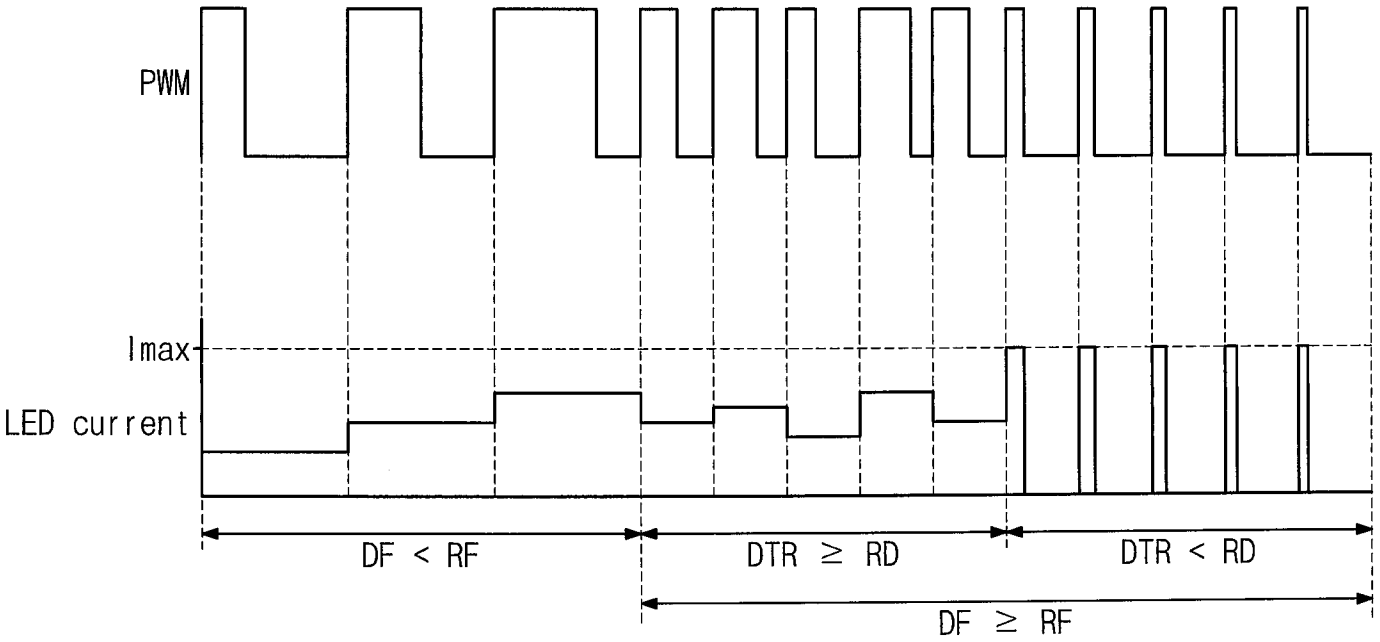
FIG. 5 is a timing diagram showing a dimming signal applied to the backlight controller and a driving current flowing through light source strings.

FIG. 4 is a block diagram showing the backlight controller 151 shown in FIG. 3, and FIG. 5 is a timing diagram showing the dimming signal applied to the backlight controller 151 and a driving current flowing through the light source strings S1-Sk. The driving current may represent the sum total of the currents passing through the light source strings S1-Sk.

The backlight controller 151 shown in FIG. 4 drives the backlight 160 in the dimming mode. For the convenience of illustration, the pulse width modulation signal PWM is shown as the dimming signal DIM in FIG. 5, and the driving current of the backlight 160 is shown as an LED current.

Referring to FIGS. 4 and 5, the backlight controller 151 includes a comparator COM that detects the frequency DF of the dimming signal DIM and compares the frequency DF with the reference frequency RF and a driver DRV that drives the backlight 160 according to the compared result.

In the case where the frequency DF of the dimming signal DIM is less than the reference frequency RF, the driver DRV drives the backlight 160 in the analog dimming mode. In the case where the frequency DF of the dimming signal DIM is equal to or greater than the reference frequency RF, the driver DRV drives the backlight 160 in the mixed dimming mode.

In the mixed dimming mode, in the case where the duty cycle (e.g., duty ratio) DRT of the dimming signal DIM is equal to or greater than the reference duty cycle (e.g., the reference duty ratio) RD, the driver DRV drives the backlight 160 in the analog dimming mode, and in the case where the duty cycle DRT of the dimming signal DIM is less than the reference duty cycle RD, the driver DRV drives the backlight 160 in the digital dimming mode.

The comparator COM includes a frequency detector 1511 and a frequency comparator 1512. The driver DRV includes a duty cycle detector (e.g., a duty ratio detector) 1513, a duty cycle comparator (e.g., a duty ratio comparator) 1514, a first driver 1515, and a second driver 1516.

The frequency detector 1511 receives the dimming signal DIM of the backlight control signal BCS and detects the frequency of the dimming signal DIM. The frequency detector 1511 applies the detected frequency DF of the dimming signal DIM to the frequency comparator 1512.

The frequency comparator 1512 compares the frequency DF of the dimming signal DIM provided from the frequency detector 1511 with the reference frequency RF. As an example, the reference frequency DF may be set to about 1 KHz. The frequency comparator 1512 includes a first memory M1 in which a value of the reference frequency RF is stored.

The frequency comparator 1512 outputs control signals different from each other according to the compared result of the frequency DF of the dimming signal DIM and the reference frequency RF. For instance, in the case where the frequency DF of the dimming signal DIM is less than the reference frequency RF, the frequency comparator 1512 outputs a first control signal CS1. In the case where the frequency DF of the dimming signal DIM is equal to or greater than the reference frequency RF, the frequency comparator 1512 outputs a second control signal CS2.

The frequency comparator 1512 applies the first control signal CS1 to the first driver 1515 and applies a second control signal CS2 to the duty cycle detector 1513.

The first driver 1515 receives the dimming signal DIM and drives the backlight 160 in the analog dimming mode in response to the first control signal CS1 provided from the frequency comparator 1512. For instance, the first driver 1515 is activated in response to the first control signal CS1 and the activated first driver 1515 drives the backlight 160 in the analog dimming mode on the basis of the dimming signal DIM applied thereto.

As shown in FIG. 5, in the case where the frequency DF of the dimming signal DIM is less than the reference frequency RF, the light source strings S1 to Sk of the backlight 160 are in a full-on state and the amount of the current applied to the light source strings S1 to Sk of the backlight 160 is controlled. Therefore, the brightness of the backlight 160 is controlled.

The analog dimming mode is a method that the amount of the current applied to the light source strings S1 to Sk is controlled depending on the duty cycle of the pulse width modulation signal PWM corresponding to the dimming signal DIM. The duty cycle indicates the ratio of the high period (or on period) to one cycle of the pulse width modulation signal PWM. For instance, when the duty cycle is about 30%, a current corresponding to about 30% of a maximum current Imax is applied to the light source strings S1 to Sk as a driving current (LED current).

Accordingly, in the case where the frequency DF of the dimming signal DIM is less than the reference frequency RF, the backlight controller 151 drives the backlight 160 in the analog dimming mode to control the brightness of the backlight 160.

The duty cycle detector 1513 receives the dimming signal DIM and detects the duty cycle DTR of the dimming signal DIM in response to the second control signal CS2 provided from the frequency comparator 1512. The duty cycle detector 1513 applies the detected duty cycle DTR of the dimming signal DIM to the duty cycle comparator 1514.

The duty cycle comparator 1514 compares the duty cycle DTR of the dimming signal DIM provided from the duty cycle detector 1513 with the reference duty cycle RD. As an example, the reference duty cycle RD may be set to about 25% of the cycle of the dimming signal DIM. The duty cycle comparator 1514 includes a second memory M2 in which the reference duty cycle RD is stored.

The duty cycle comparator 1514 outputs the control signals different from each other according to the compared result of the duty cycle DTR of the dimming signal DIM and the reference duty cycle RD. For instance, in the case where the duty cycle DTR of the dimming signal DIM is equal to or greater than the reference duty cycle RD, the duty cycle comparator 1514 outputs a third control signal CS3. In the case where the duty cycle DTR of the dimming signal DIM is less than the reference duty cycle RD, the duty cycle comparator 1514 outputs a fourth control signal CS4.

The duty cycle comparator 1514 applies the third control signal CS3 to the first driver 1515 and applies the fourth control signal CS4 to the second driver 1516.

The first driver 1515 receives the dimming signal DIM and drives the backlight 160 in the analog dimming mode in response to the third control signal CS3 provided from the duty cycle comparator 1514. The operation in which the first driver 1515 controls the backlight 160 in response to the third control signal CS3 is substantially the same as the operation in which the first driver 1515 controls the backlight 160 in response to the first control signal CS1.

As shown in FIG. 5, in the case where the frequency DF of the dimming signal DIM is equal to or greater than the reference frequency RF and the duty cycle DTR of the dimming signal DIM is equal to or greater than the reference duty cycle RD, the light source strings S1 to Sk are maintained in the full-on state and the amount of the current applied to the light source strings S1 to Sk is controlled, thereby controlling the brightness of the backlight 160.

The second driver 1516 receives the dimming signal DIM and drives the backlight 160 in the digital dimming mode in response to the fourth control signal CS4 provided from the duty cycle comparator 1514. For instance, the second driver 1516 is activated in response to the fourth control signal CS4 and the activated second driver 1516 drives the backlight 160 in the digital dimming mode on the basis of the dimming signal DIM applied thereto.

As shown in FIG. 5, in the case where the frequency DF of the dimming signal DIM is equal to or greater than the reference frequency RF, and the duty cycle DTR of the dimming signal DIM is less than the reference duty cycle RD, the on/off operation of the light source strings S1 to Sk of the backlight 160 is controlled, and thus the brightness of the backlight 160 is controlled.

The digital dimming mode is a method in which the light source strings S1 to Sk are turned on during the high level period of the pulse width modulation signal PWM corresponding to the dimming signal DIM. For instance, in the case where the duty cycle is about 30%, the light source strings S1 to Sk are turned on during a period corresponding to about 30% of the one cycle of the dimming signal DIM.

Therefore, in the case where the frequency DF of the dimming signal DIM is equal to or greater than the reference frequency RF, the backlight controller 151 drives the backlight 160 in the mixed dimming mode to control the brightness of the backlight 160.

In the case where the brightness of the backlight 160 linearly increases in proportion to the duty cycle DTR of the dimming signal DIM, the brightness of the backlight 160 may be precisely controlled. In the case where the duty cycle DTR of the dimming signal DIM is low in the analog dimming mode, the brightness of the backlight 160 is not linearly increased. Thus, the analog dimming mode has a disadvantage in that the brightness is difficult to control at a low grayscale level in the analog dimming mode.

For instance, in the case where the duty cycle DTR of the dimming signal DIM is less than the reference duty cycle RD in the analog dimming mode, the brightness of the backlight 160 may not be linearly increased in proportion to the duty cycle DTR of the dimming signal DIM. In the case where the duty cycle DTR of the dimming signal DIM is equal to or greater than the reference duty cycle RD in the analog dimming mode, the brightness of the backlight 160 may be linearly increased in proportion to the duty cycle DTR of the dimming signal DIM.

In the digital dimming mode, the brightness of the backlight 160 is linearly increased in proportion to the duty cycle DTR of the dimming signal DIM. Accordingly, the digital dimming mode may precisely control the brightness of the backlight 160.

In the present exemplary embodiment, in the case where the frequency DF of the dimming signal DIM is equal to or greater than the reference frequency RF and the duty cycle DTR of the dimming signal DIM is less than the reference duty cycle RF, the backlight 160 is driven in the digital dimming mode, and thus the brightness of the backlight 160 is precisely controlled.

In the case where the backlight 160 is driven in the digital dimming mode, a waterfall phenomenon may occur. Although the backlight 160 is driven in the digital dimming mode, the waterfall phenomenon may not be perceived in the case where the dimming signal DIM has a high frequency equal to or greater than the reference frequency RF. However, in the case where the backlight 160 is driven in the digital dimming mode and the dimming signal DIM has a low frequency less than the reference frequency RF, the waterfall phenomenon may be perceived. The waterfall phenomenon will be described in further detail below.

Figure 6A:
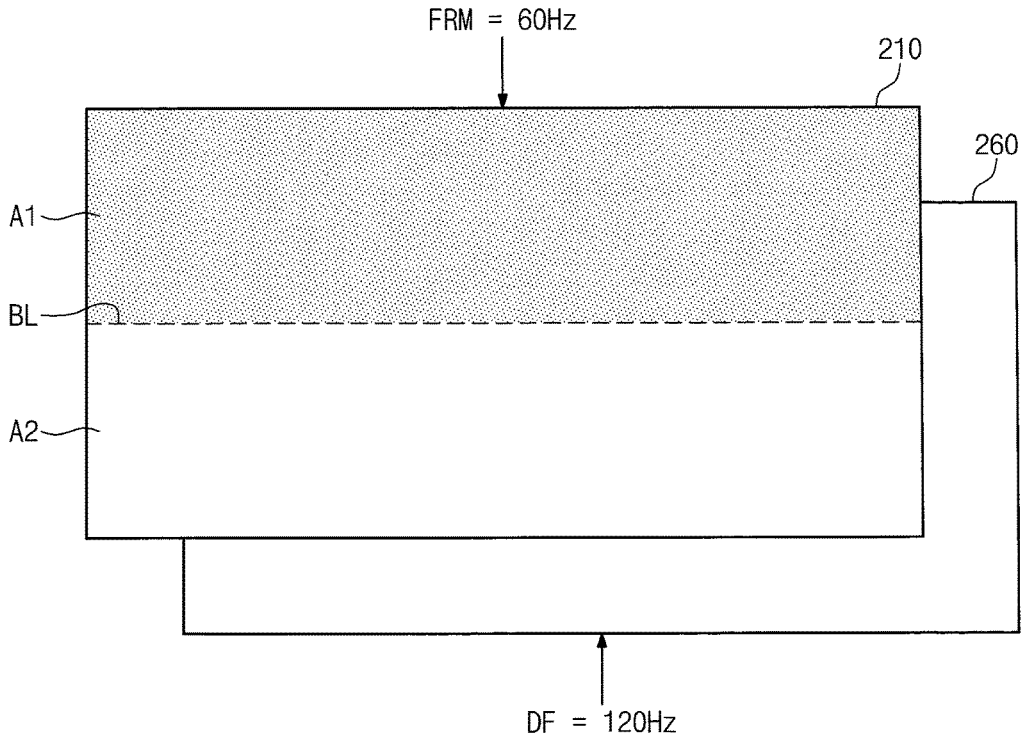
FIGS. 6A-6B are views illustrating a waterfall phenomenon.
Figure 6B:
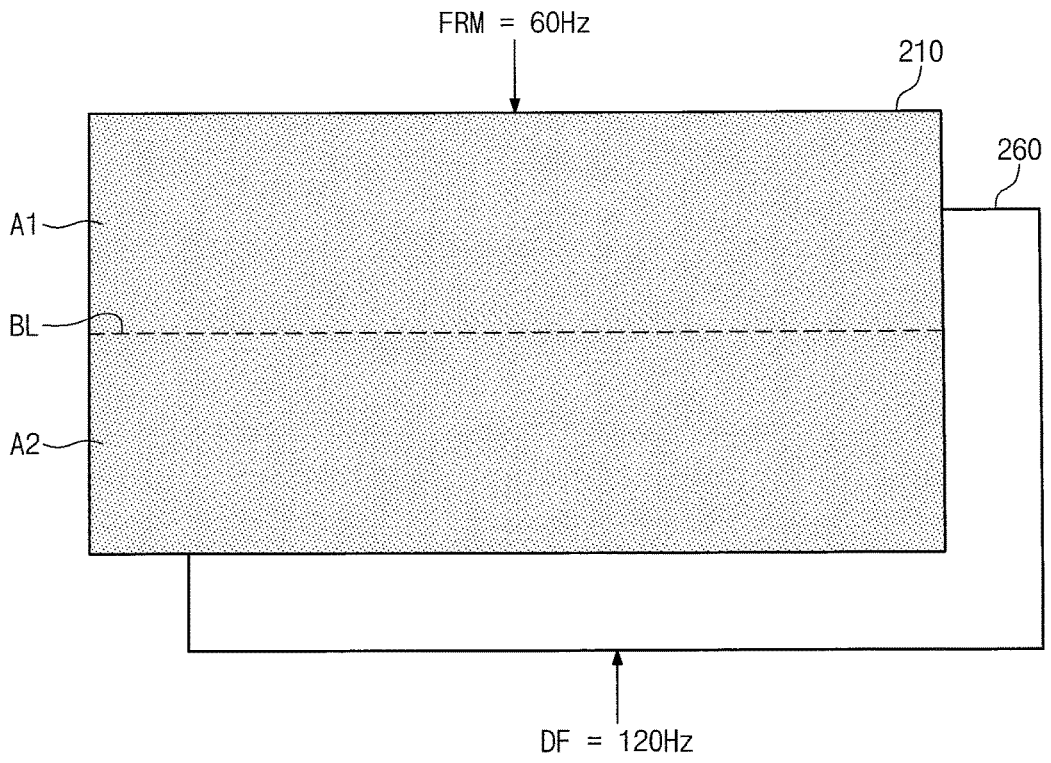

FIGS. 6A and 6B are views illustrating a waterfall phenomenon.

Hereinafter, a display panel 210 and a comparison backlight 260 shown in FIGS. 6A and 6B are respectively referred to as a comparison display panel 210 and a comparison backlight 260.

Referring to FIGS. 6A and 6B, the comparison backlight 260 may be driven in the dimming mode without taking the frequency of the dimming signal into consideration.

An operation frequency of the comparison display panel 210 may be defined as a frame frequency FRM and may be about 60 Hz. In the case where the frame frequency FRM is about 60 Hz, the image signals are applied to the comparison display panel 210 at sixty times per second.

In the case where the frequency DF of the dimming signal is about 120 Hz and the comparison backlight 260 is driven in the digital dimming mode, the comparison backlight 260 is turned on 120 times per second. Therefore, in the case where the comparison display panel 210 displays the image once, the comparison backlight 260 is turned two times.

As shown in FIG. 6A, in the case where pixels PX arranged in a first area A1 corresponding to a half of the comparison display panel 210 are charged with the data voltages, the comparison backlight 260 is turned on and provides the comparison display panel 210 with the light.

As shown in FIG. 6B, in the case where pixels PX arranged in a second area A2 corresponding to the other half of the comparison display panel 210 are charged with the data voltages, the comparison backlight 260 is turned on again and provides the comparison display panel 210 with the light. In this case, a difference in brightness between the first and second areas A1 and A2 occurs and a boundary line BL between the first and second areas A1 and A2 may be perceived.

In the above-mentioned description, the operation of the comparison display panel 210 has been described in the case where the frame frequency FRM is two times greater than the frequency DF of the dimming signal, but the frequency DF of the dimming signal may be suitably varied. In the case where the frequency DF of the dimming signal is varied, the number of the boundary lines BL and the position of the boundary line BL become different every frame, and as a result, the waterfall phenomenon in which the boundary line BL moves up and down may occur.

In the present exemplary embodiment, in the case where the frequency DF of the dimming signal DIM is less than the reference frequency RF, the backlight 160 is driven in the analog dimming mode. Because the light source strings S1 to Sk of the backlight 160 are maintained in the full-on state during the analog dimming mode, the waterfall phenomenon does not occurs.

Consequently, because the backlight unit BLU and the display device 100 including the backlight unit BLU drive the backlight 160 in the analog dimming mode or the mixed dimming mode in accordance with the frequency DF of the dimming signal DIM, the waterfall phenomenon may be prevented from occurring. Thus, the display quality of the display device 100 may be improved.

Figure 7:
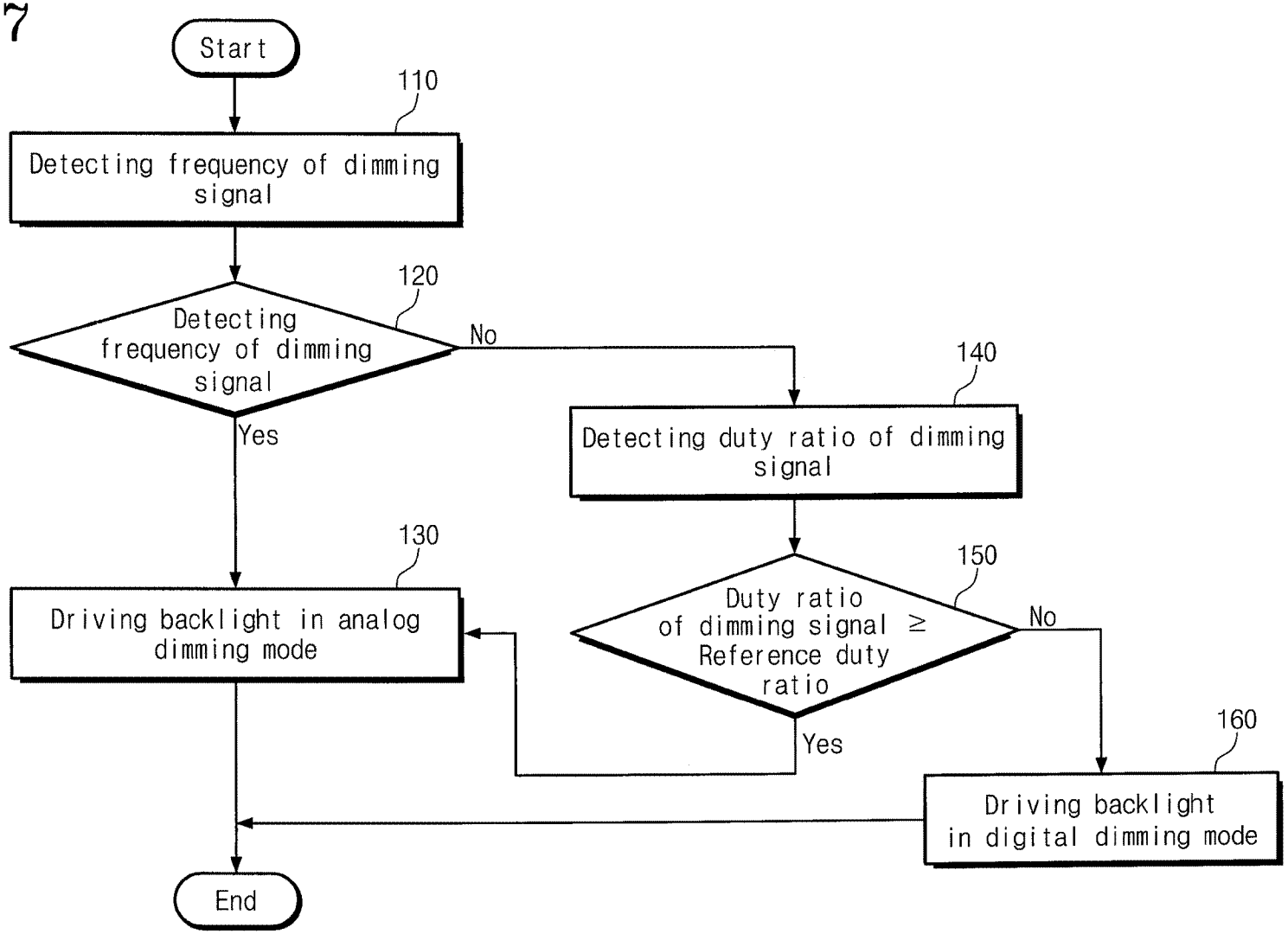
FIG. 7 is a flow diagram showing a method of driving a backlight unit according to an exemplary embodiment of the present disclosure.

FIG. 7 is a flow diagram showing a method of driving the backlight unit BLU according to an exemplary embodiment of the present disclosure.

Referring to FIG. 7, the frequency DF of the dimming signal DIM is detected (S110) to drive the backlight 160 in the dimming mode. Then, the detected frequency DF of the dimming signal DIM is compared with the reference frequency RF (S120). For instance, it is checked whether the frequency DF of the dimming signal DIM is less than the reference frequency RF in the operation S120.

In the case where the frequency DF of the dimming signal DIM is less than the reference frequency RF, the backlight 160 is driven in the analog dimming mode (S130). In the case where the frequency DF of the dimming signal DIM is equal to or greater than the reference frequency RF, the duty cycle DTR of the dimming signal DIM is detected (S140).

The detected duty cycle DTR of the dimming signal DIM is compared with the reference duty cycle RD (S150). For instance, it is checked whether the duty cycle DTR of the dimming signal DIM is equal to or greater than the reference duty cycle RD in the operation S150.

In the case where the duty cycle DTR of the dimming signal DIM is equal to or greater than the reference duty cycle RD, the backlight 160 is driven in the analog dimming mode (S130). In the case where the duty cycle DTR of the dimming signal DIM is less than the reference duty cycle RD, the backlight 160 is driven in the digital dimming mode. Accordingly, when the frequency DF of the dimming signal DIM is equal to or greater than the reference frequency RF, the backlight 160 is driven in the mixed dimming mode.

The light generated by the backlight 160 is provided to the display panel 110 and the display panel 110 displays the image using the light provided from the backlight 160.

By applying the driving method of the backlight unit BLU according to the present exemplary embodiment, the backlight 160 is driven in the analog dimming mode or the mixed dimming mode according to the frequency DF of the dimming signal DIM, and thus the waterfall is prevented from occurring, or is reduced. Therefore, the display quality of the display panel 110 may be improved.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components, such as the timing controller, the gate driver, the data driver, and the backlight driver, according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Although the exemplary embodiments of the present invention have been described, it is understood that the present invention should not be limited to these exemplary embodiments but various suitable changes and modifications can be made by one ordinary skilled in the art within the spirit and scope of the present invention as defined by the appended claims and equivalents thereof.

What is claimed is:

1. A backlight unit comprising:

a backlight configured to generate light; and a backlight driving circuit configured to drive the backlight in a dimming mode on a basis of a dimming signal, the backlight driving circuit comprising:

a first comparator configured to detect a frequency of the dimming signal and to compare the frequency of the dimming signal with a reference frequency to determine a compared result; and a driver configured to selectively drive the backlight, based on the compared result, in an analog dimming mode in which a driving current of the backlight is controlled, or a mixed dimming mode by mixing the analog dimming mode and a digital dimming mode in which an on state and an off state of the backlight is controlled, wherein the driver is configured to drive the backlight in the analog dimming mode when the frequency of the dimming signal is less than the reference frequency, to drive the backlight in the analog dimming mode when the frequency of the dimming signal is equal to or greater than the reference frequency and a duty cycle of the dimming signal is equal to or greater than a reference duty cycle, and to drive the backlight in the digital dimming mode when the frequency of the dimming signal is equal to or greater than the reference frequency and the duty cycle of the dimming signal is less than the reference duty cycle.

2. The backlight unit of claim 1, wherein the dimming signal is a pulse width modulation signal.

3. The backlight unit of claim 1, wherein the reference frequency is about 1 KHz.

4. The backlight unit of claim 1, wherein the reference duty cycle is about 25%.

5. The backlight unit of claim 1, wherein the first comparator comprises:

a frequency detector configured to detect the frequency of the dimming signal; and a frequency comparator configured to compare the frequency of the dimming signal with the reference frequency to output the compared result.

6. The backlight unit of claim 5, wherein the frequency comparator is configured to output a first control signal when the frequency of the dimming signal is less than the reference frequency, and to output a second control signal when the frequency of the dimming signal is equal to or greater than the reference frequency.

7. The backlight unit of claim 6, wherein the driver comprises:

a duty cycle detector configured to detect the duty cycle of the dimming signal in response to the second control signal;

a duty cycle comparator configured to compare the duty cycle of the dimming signal with the reference duty cycle, to output a third control signal when the duty cycle of the dimming signal is equal to or greater than the reference duty cycle, and to output a fourth control signal when the duty cycle of the dimming signal is less than the reference duty cycle;

a first driver configured to drive the backlight in the analog dimming mode on a basis of the dimming signal in response to the first and third control signals; and a second driver configured to drive the backlight in the digital dimming mode on the basis of the dimming signal in response to the fourth control signal.

8. The backlight unit of claim 7, wherein the frequency comparator comprises a first memory configured to store a value of the reference frequency, and wherein the duty cycle comparator comprises a second memory configured to store a value of the reference duty cycle.

9. A method of driving a backlight unit, the method comprising:

detecting a frequency of a dimming signal;

comparing the frequency of the dimming signal with a reference frequency to determine a compared result; and selectively driving a backlight, based on the compared result, in an analog dimming mode in which a driving current of the backlight is controlled, or a mixed dimming mode by mixing the analog dimming mode and a digital dimming mode in which an on state and an off state of the backlight are controlled, wherein the driving of the backlight comprises:

driving the backlight in the analog dimming mode on a basis of the dimming signal when the frequency of the dimming signal is less than the reference frequency;

driving the backlight in the analog dimming mode on the basis of the dimming signal when the frequency of the dimming signal is equal to or greater than the reference frequency and a duty cycle of the dimming signal is equal to or greater than a reference duty cycle; and driving the backlight in the digital dimming mode on the basis of the dimming signal when the frequency of the dimming signal is equal to or greater than the reference frequency and the duty cycle is less than the reference duty cycle.

10. The method of claim 9, wherein the reference frequency is about 1 KHz.

11. The method of claim 9, wherein the driving of the backlight in the mixed dimming mode comprises:

detecting the duty cycle of the dimming signal;

comparing the duty cycle of the dimming signal with the reference duty cycle; and driving the backlight in the analog dimming mode or the digital dimming mode according to a result of the comparison of the duty cycle of the dimming signal and the reference duty cycle.

12. The method of claim 11, wherein the reference duty cycle is about 25%.

13. A display device comprising:

a display panel;

a backlight configured to provide light to the display panel;

a first comparator configured to detect a frequency of a dimming signal and to compare the frequency of the dimming signal with a reference frequency to determine a compared result; and a driver configured to selectively drive the backlight in a dimming mode on a basis of the dimming signal, wherein the driver is configured to drive the backlight, based on the compared result, in an analog dimming mode in which a driving current of the backlight is controlled or a mixed dimming mode by mixing the analog dimming mode and a digital dimming mode in which on and off of the backlight are controlled, wherein the driver is configured to drive the backlight in the analog dimming mode when the frequency of the dimming signal is less than the reference frequency, to drive the backlight in the analog dimming mode when the frequency of the dimming signal is equal to or greater than the reference frequency and a duty cycle of the dimming signal is equal to or greater than a reference duty cycle, and to drive the backlight in the digital dimming mode when the frequency of the dimming signal is equal to or greater than the reference frequency and the duty cycle of the dimming signal is less than the reference duty cycle.

14. The display device of claim 13, wherein the first comparator comprises:

a frequency detector configured to detect the frequency of the dimming signal; and a frequency comparator configured to compare the frequency of the dimming signal with the reference frequency, to output a first control signal when the frequency of the dimming signal is less than the reference frequency, and to output a second control signal when the frequency of the dimming signal is equal to or greater than the reference frequency.

15. The display device of claim 14, wherein the driver comprises:

a duty cycle detector configured to detect the duty cycle of the dimming signal in response to the second control signal;

a duty cycle comparator configured to compare the duty cycle of the dimming signal with the reference duty cycle, to output a third control signal when the duty cycle of the dimming signal is equal to or greater than the reference duty cycle, and to output a fourth control signal when the duty cycle of the dimming signal is less than the reference duty cycle;

a first driver configured to drive the backlight in the analog dimming mode on the basis of the dimming signal in response to the first and third control signals; and a second driver configured to drive the backlight in the digital dimming mode on the basis of the dimming signal in response to the fourth control signal.

* * * * *